US007961901B2

(12) United States Patent
König

(10) Patent No.: US 7,961,901 B2
(45) Date of Patent: Jun. 14, 2011

(54) LOUDSPEAKER STAND AND MOUNT FOR A LOUDSPEAKER STAND

(75) Inventor: Martin König, Wertheim (DE)

(73) Assignee: König & Meyer GmbH & Co. KG, Wertheim (DE)

( * ) Notice: Subject to any disclaimer, the term of this patent is extended or adjusted under 35 U.S.C. 154(b) by 887 days.

(21) Appl. No.: 11/983,231

(22) Filed: Nov. 8, 2007

(65) Prior Publication Data

US 2008/0112588 A1 May 15, 2008

(30) Foreign Application Priority Data

Nov. 9, 2006 (DE) ..... 10 2006 052 822
Feb. 23, 2007 (DE) ..... 10 2007 008 974

(51) Int. Cl.
*H04R 25/00* (2006.01)

(52) U.S. Cl. ..... 381/390; 381/334; 381/363; 381/386

(58) Field of Classification Search ..... 381/334, 381/361, 363, 386, 387, 390, 392, 395
See application file for complete search history.

(56) References Cited

U.S. PATENT DOCUMENTS

| | | | | |
|---|---|---|---|---|
| 288,183 | A * | 11/1883 | Ohly | 381/390 |
| 6,513,768 | B1 | 2/2003 | Hsieh | |
| 7,155,027 | B2 * | 12/2006 | Lee | 381/390 |
| 2005/0100187 | A1 * | 5/2005 | Yang | 381/386 |

FOREIGN PATENT DOCUMENTS

| | | |
|---|---|---|
| DE | 89 07 203 | 8/1989 |
| DE | 195 11 074 | 8/1996 |
| DE | 200 10 582 | 10/2000 |
| EP | 1814353 A | 8/2007 |
| WO | 97/16097 A | 5/1997 |

* cited by examiner

*Primary Examiner* — Suhan Ni
(74) *Attorney, Agent, or Firm* — Lucas & Mercanti, LLP; Klaus P. Stoffel

(57) ABSTRACT

A loudspeaker stand has a mount, onto which a loudspeaker can be placed. For this purpose, the mount has a tensioning device, which can be actuated by the intrinsic weight of the loudspeaker. The stand may have several tensioning elements, which can be shifted in a direction perpendicular to that in which the loudspeaker is set down.

15 Claims, 1 Drawing Sheet

LOUDSPEAKER STAND AND MOUNT FOR A LOUDSPEAKER STAND

BACKGROUND OF THE INVENTION

1. Field of the Invention

The present invention relates to a loudspeaker stand with a mount onto which a loudspeaker can be placed, and to a mount for a loudspeaker stand of this type.

2. Description of the Related Art

A loudspeaker stand of this type is known from DE 89 07 203 U1. The mount has a height-adjustable vertical column, to the upper end of which the loudspeaker can be attached. The column is designed as a spring strut, which can travel outward automatically and lift the loudspeaker by the force of a spring.

Another loudspeaker stand is known from DE 195 11 074 C1. Here the loudspeaker enclosure is mounted on a bar, wherein a wire extends through the interior of the bar.

Large loudspeakers can be very heavy, in many cases as much as 8 to 65 kg. So that loudspeakers can be positioned appropriately for the playback of the music, they are often arranged on stands or tripods. Loudspeakers can also be mounted on wall brackets.

So that the loudspeaker can be positioned on the stand, the enclosure often has a flange, which, in the most general possible way, is designed in the form of a hollow cylinder.

For example, DE 200 10 582 U1 describes a loudspeaker system with a loudspeaker enclosure which has three hollow cylindrical flanges which are arranged at different angles to the bottom of the enclosure. The loudspeaker will assume a different angle depending on the flange on which it is mounted.

The support offered to a loudspeaker by a loudspeaker stand of this type, however, is still relatively unstable. Although the loudspeaker is prevented from falling by the cooperation between the mount and the flange, in some cases the flange still allows the loudspeaker a considerable amount of play with respect to the mount. One of the reasons for this is that loudspeakers in Europe have an inside flange diameter of 35 mm, whereas in the USA, for example, loudspeakers have an inside flange diameter of 1.5 inches or approximately 38 mm. In many cases, furthermore, the inside surface of the flange is not precisely cylindrical. In particular, it can be tapered, especially in the case of castings. As a result, a certain amount of play is again present between the flange and the mount.

The play between the loudspeaker and the stand makes it easier for the loudspeaker to be mounted and removed, but it also has acoustic disadvantages. For example, many loudspeakers tend to rattle after they have been mounted on the stand. If the loudspeaker is to be installed at a tilt and the axis of the mount is therefore not precisely vertical, it is impossible in practice to keep the loudspeaker facing in the desired direction. During use, the loudspeaker vibrates, and this causes the loudspeaker to rotate until its center of gravity is at the lowest possible point.

SUMMARY OF THE INVENTION

It is the object of the invention to reliably support a loudspeaker.

This object is met with a loudspeaker stand of the type indicated above in that the mount has a tensioning device, which can be actuated by the intrinsic weight of the loudspeaker.

The tensioning device clamps the loudspeaker enclosure to the mount, so that, in the mounted state, there is no longer any play between the loudspeaker—or, more precisely, its flange—and the mount. Accordingly, the loudspeaker enclosure will not rattle during use. The clamping action of the tensioning device is provided automatically in that the loudspeaker actuates the tensioning device by the force of its own weight. It is therefore only necessary to place the flange of the loudspeaker on the mount and to let go. The loudspeaker will then sink down a little farther, and, as a result, the tensioning device will be actuated and clamp the loudspeaker to the mount. When the loudspeaker is to be removed from the mount, it is necessary to lift it only slightly against the action of the tensioning device. After lifting the loudspeaker only slightly, the action of the tensioning device will have decreased to such an extent that only the intrinsic weight of the loudspeaker enclosure remains to be lifted. As a result, the processes of mounting the loudspeaker on the stand and of removing it again are greatly simplified. If the mount is at an angle to the vertical, the tensioning device will hold the loudspeaker in position, facing in the desired direction. For this purpose it is necessary merely to hold the loudspeaker so that it is facing in the desired direction and to place it on the mount in this position until the tensioning device has gripped the loudspeaker. The loudspeaker usually has to descend only a relatively short distance before this happens.

The tensioning device preferably has several tensioning elements which can shift in the direction perpendicular to that in which the loudspeaker is set down on the mount. These tensioning elements will press themselves with a certain force from the inside against the flange of the loudspeaker and thus eliminate any preexisting play between the flange and the mount. The loudspeaker will then be held in position by the clamping force between the tensioning elements and the flange.

It is preferable in this case for the tensioning elements to cooperate with a restoring spring arrangement. This facilitates the removal of the loudspeaker from the stand. As soon as the actuating force decreases sufficiently, i.e., as soon as the loudspeaker is lifted against the force of gravity, the tensioning elements will be pulled back from the inside surface of the flange by the restoring spring arrangement, which effectively releases the loudspeaker enclosure from the mount.

It is preferable for the restoring spring arrangement to have at least one elastic ring which surrounds the tensioning elements. This ring therefore acts as an annular spring. It can be made of an elastomeric material such as rubber, for example. It is also possible to use a commercially obtainable round sealing ring or O-ring for the restoring spring arrangement.

The tensioning device preferably has an expanding mandrel with at least one wedge surface, which cooperates with an opposing wedge surface on a tensioning element. When the expanding mandrel is shifted by the weight of the loudspeaker, the wedge surface cooperates with the opposing wedge surface and pushes the tensioning element outward, so that it rests from the inside against the flange of the loudspeaker. When the tensioning element can no longer move in the radial direction, the expanding mandrel also stops moving, and the loudspeaker is now held in its final position.

It is preferable for the wedge surface and the opposing wedge surface to be flat. The wedge surface and the opposing wedge surface can thus rest flat against each other regardless of how far the expanding mandrel may move. Relatively large spreading forces can thus be generated and transmitted.

The expanding mandrel preferably has several wedge surfaces for at least one of the tensioning elements, these surfaces being arranged in a row in the setting-down direction. This offers several advantages. First, this makes it possible to increase the length of the tensioning element and at the same time to stabilize it parallel to the setting-down direction in spite of its greater length. This can be done in particular by providing a pair of wedge surfaces, i.e., a mandrel wedge surface and an opposing wedge surface, at both the top and the bottom of the tensioning element. If wedge surfaces can actuate the tensioning element at several points along its length, tensioning forces can be transmitted over the entire length of this longer tensioning element.

The expanding mandrel is preferably designed so that it can be pushed inward into the mount against the force of a spring. This, too, makes it easier to remove the loudspeaker from the stand. When the loudspeaker enclosure is raised slightly, the spring pushes the expanding mandrel into its release position, which allows the tensioning elements to retract. The loudspeaker can then be lifted from the stand without the need to exert any extra force.

The tensioning elements preferably have a decoupling layer on their outward-facing surface. The decoupling layer can be relatively thin. Its only purpose is to decrease or even to eliminate the extent to which vibrations are transmitted from the flange of the loudspeaker to the tensioning elements and thus to the stand. This can be achieved in many cases simply by incorporating a certain amount of air into the decoupling layer.

This is easily achieved by constructing the decoupling layer as a flock coating. Flocking gives the outside surface of the tensioning elements a velvety appearance. By adjusting the parameters of the flocking process, the decoupling properties of the insulating layer can be varied as desired.

At least one tensioning element preferably has a strip of elastomeric material on its outward-facing surface. This strip projects slightly beyond the tensioning element. When the tensioning element is clamped to the inside surface of the flange of the loudspeaker, the strip is slightly compressed, which contributes to the effectiveness of the vibrational decoupling.

It is preferable for the strip to be inserted into a slot in the tensioning element. Two advantages are obtained by implementing this measure. First, the strip is mechanically stabilized in the slot and thus in the tensioning element. Second, it is possible to replace the strip easily, after it has become worn. For this purpose, it is necessary merely to pull it out of the slot, and then to insert a new strip into the empty slot.

At least certain sections of the bottom of the slot are preferably parallel to the opposing wedge surface, and the bottom preferably also has a shoulder near at least one opposing wedge surface. The strip, furthermore, has at least one hook on its inside surface, i.e., the surface which has been inserted into the slot. This hook cooperates with the shoulder. Thus the strip is prevented from moving in the axial direction in the tensioning element, that is, in the direction parallel to that in which the loudspeaker is set down, by the cooperation between the hook and the shoulder. When, during the setting-down process, the loudspeaker is moved slightly while the tensioning elements are already resting from the inside against the flange of the loudspeaker but the clamping force is still sufficient to prevent any further movement of the loudspeaker, there will be a certain amount of friction between the flange of the loudspeaker and the strip. Because the strip is supported in the tensioning element, however, this friction can be easily tolerated.

The strip is preferably arranged inside the elastic ring. Thus the strip is captured. The elastic ring holds the strip simultaneously in the slot.

The mount is preferably connected to a pedestal base or tripod.

A pedestal base or tripod is used so that the loudspeaker can be placed on a support surface such as a floor or a table. When the mount is connected to a tripod of this type, it can be used to attach the loudspeaker to the tripod and thus to support the loudspeaker reliably.

As an alternative, the mount can be connected to a wall bracket. A wall bracket is usually installed permanently on the wall. Here, too, the mount can be used to attach the loudspeaker reliably to the wall bracket.

The invention also pertains to a mount for a loudspeaker stand of this type in which the previously mentioned task is accomplished by providing the mount with a tensioning device, which can be actuated by the intrinsic weight of a loudspeaker, and with a fastening device, by means of which the mount can be attached to a support. A mount of this type can be provided as a replacement part for a loudspeaker tripod, a wall bracket, a ceiling bracket, or the like, or it can be used to retrofit a tripod or bracket. As soon as the mount has been connected to the corresponding base part, a loudspeaker can be mounted on it, and it will then be held securely on the base part. The design of the base part as a tripod, wall bracket, ceiling bracket, or the like depends on the purpose of the desired application.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
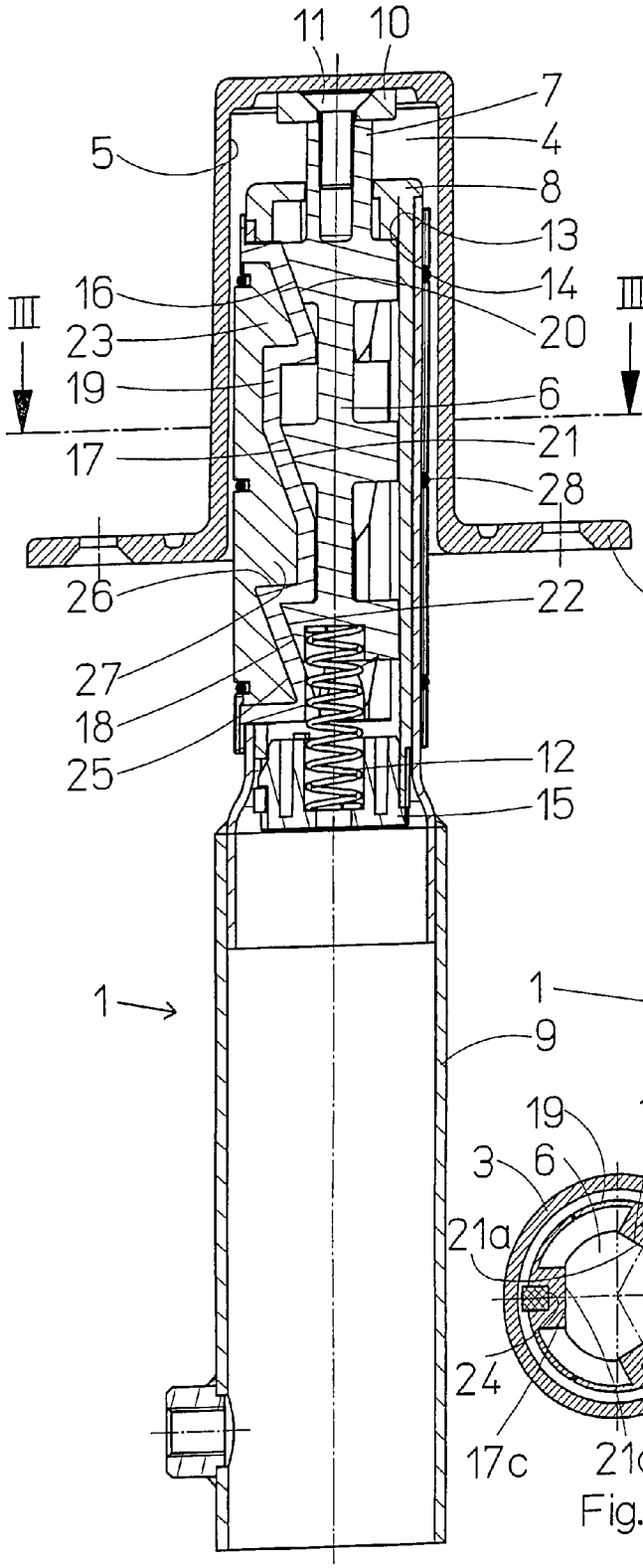
FIG. 1 is a cross-sectional view of a loudspeaker stand.
Figure 2:
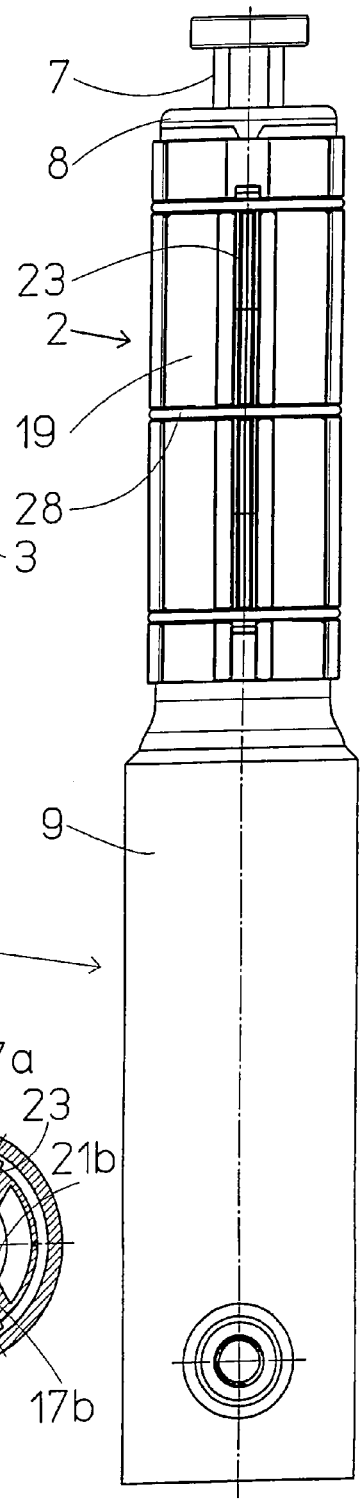
FIG. 2 is a side view of the loudspeaker stand.

FIG. 1 shows a loudspeaker stand 1 with a mount 2, on which a loudspeaker can be mounted. Only a flange 3 of the loudspeaker is shown; it has a hollow, more-or-less cylindrical opening 4. The diameter of this opening in the case of European loudspeakers is approximately 35 mm, and in the case of American loudspeakers it is approximately 1.5 inches or 38 mm. In addition, the diameter is usually subject to rather wide manufacturing tolerances. The opening 4 can also have conically tapering inside walls 5, especially when the flange 3 has been designed as an injection-molded part. Nevertheless, it is desirable to mount a loudspeaker on the loudspeaker stand 1 so that it will be held firmly in position. Play between the mount 2 and the flange 3 can lead to annoying noise during the use of the loudspeaker.

To eliminate play between the mount 2 and the flange 3 and to ensure that the loudspeaker is held securely on the loudspeaker stand, the mount 2 is provided with a tensioning device, which has an expanding mandrel 6. The expanding mandrel 6 has an extension 7 at the top, which projects out of a housing 8, which is connected to a base 9 of the tripod. The base 9 can be attached to a stand and set up on the floor in the conventional manner, or it can be attached to a wall bracket. When special situations require, the base can also be attached to a different type of support. In addition to the floor stand, it would also be possible to use a table stand or a ceiling bracket. The mount 2 can also be attached to structures on a stage, to a backdrop, or the like. The base 9 is shown here as a section of tubing, which is provided with a threaded hole in the side, through which a clamping screw can be screwed. The base 9 can also be designed in other ways, too, however. It can be a threaded bolt, for example, a plug-in pin, a clamping device.

The expanding mandrel 6 carries a thrust plate 10 at the top end of the extension 7. This plate is attached by a screw 11 to the extension 7. The thrust plate 10 increases the size of the support surface for the flange 3.

The expanding mandrel 6 can shift its position in the housing 8 against the force of a spring 12. Because, when a loudspeaker is set down onto the mount, the mandrel moves under the weight of the loudspeaker, the direction in which the spring 12 acts is also referred to as the "setting-down direction".

The expanding mandrel 6 has a stop 13, which comes to rest against an opposing stop 14 in the housing 8 when the spring 12 has reached its greatest length. The spring 12 in turn is held in place in the housing 8 by a screwed-in plug 15.

Figure 3:
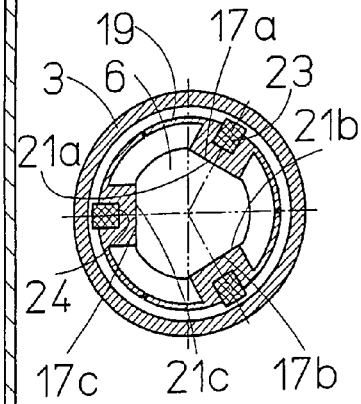
FIG. 3 is a cross sectional view along line III-III in FIG. 1.

The expanding mandrel 6 has several wedge surfaces 16-18, which are designed as flat surfaces. In the circumferential direction, each wedge surface 16-18 can be divided into several surface sectional areas, e.g., into three surface sectional areas, which are spaced 120° apart. In FIG. 3, it is possible to see the three surface sectional areas 17*a*, 17*b*, 17*c* of the expanding mandrel 6. The wedge surfaces 16 and 18 can also be divided into several surface sectional areas in the same way.

Several tensioning elements 19 are provided in the housing 8. The number of tensioning elements 19 corresponds to the number of surface sectional areas 17*a*, 17*b*, 17*c* of the wedge surface; in the present case, the mount 2 accordingly has three tensioning elements 19. The tensioning elements 19 could also be called "clamping jaws".

Each tensioning element 19 is opposed by wedge surfaces 20-22 equal in number to the number of its own wedge surfaces 16-18. The opposing wedge surfaces 20-22 are also flat and can be divided in the circumferential direction into several surface sectional areas 21*a*, 21*b*, 21*c*, as can be seen in FIG. 3.

Each tensioning element 19 is provided in the center, circumferentially speaking, with a strip 23 of elastomeric material. The strip 23 is inserted into a slot 24, the bottom 25 of which is parallel to the opposing wedge surfaces 20-22. As a result, the bottom 25 has several shoulders 26, against which the hooks 27 of the strip 23 rest. The strip 23 is therefore prevented from shifting position in the tensioning element in the setting-down direction.

All of the tensioning elements 19 are held together in the circumferential direction by several elastic rings 28. The elastic rings 28 also hold the strips 23 in the tensioning elements 19.

The surface of the tensioning elements 19 outside the strips 23 is also provided with a flock coating. This can be a coating of polyamide, for example. The tensioning elements 19 therefore have a velvety surface. This and the strips 23 together result in excellent acoustic decoupling between the flange 3 and the mount 2, so that practically no noise is transmitted between the loudspeaker enclosure and the stand.

When a loudspeaker is set down by its flange 3 onto the mount 2 of the stand 1, it acts on the expanding mandrel 6 by way of the thrust plate 10 and the extension 7. The expanding mandrel 6 is pushed down against the force of the spring 12. The wedge surfaces 16-18 now cooperate with the opposing wedge surfaces 20-22, so that the tensioning elements 19 are pushed radially outward and their strips 23 come to rest from the inside against the flange 3. At a certain point, the tensioning elements 19 are stopped by the flange 3 and cannot move any farther outward; at this point, the movement of the expanding mandrel 6 also stops. The flange 3 and thus the loudspeaker are now held securely in position on the stand. The loudspeaker therefore holds itself on the stand, so to speak, simply by the force of gravity and the clamping effect of the tensioning elements 19 which this force produces As long as no other forces besides gravity are acting on the loudspeaker, the loudspeaker is secured in position with respect to the stand 1 and is prevented from making either translational or rotational movement. The strips 23 on the tensioning elements 19 help to increase the friction with respect to the flange 3.

To remove the loudspeaker, it is enough just to lift it slightly. When this is done, the spring 12 pushes the expanding mandrel 6 in the release direction, that is, opposite to the setting-down direction. At the same time, the rings 28 pull the tensioning elements 19 together, so that the clamping action between the tensioning elements 19 and the flange 3 is suspended. After a relatively short movement, only the intrinsic weight of the loudspeaker enclosure is in play, which means that the loudspeaker can be lifted from the stand 1 without difficulty.

The mount 2 is preferably used in conjunction with a stand (not shown) or with a wall bracket. It can also be used individually, however, as a replacement part or for retrofitting.

While specific embodiments of the invention have been described in detail to illustrate the inventive principles, it will be understood that the invention may be embodied otherwise without departing from such principles.

I claim:

1. A loudspeaker stand comprising a mount onto which a loudspeaker can be placed, wherein the mount has a tensioning device which can be actuated by the intrinsic weight of the loudspeaker, wherein the tensioning device has several tensioning elements, which can be shifted in a direction perpendicular to that in which the loudspeaker is set down, wherein the tensioning device has an expanding mandrel with at least one wedge surface which cooperates with an opposing wedge surface of a tensioning element.

2. The loudspeaker stand according to claim 1, further comprising a restoring spring arrangement for cooperating with the tensioning elements.

3. The loudspeaker stand according to claim 2, wherein the restoring spring arrangement has at least one elastic ring which surrounds the tensioning elements.

4. The loudspeaker stand according to claim 1, wherein the wedge surface and the opposing wedge surface are flat surfaces.

5. The loudspeaker stand according to claim 1, wherein the expanding mandrel has several wedge surfaces for at least one tensioning element, these surfaces being arranged in a row in the setting-down direction.

6. The loudspeaker stand according claim 1, wherein the expanding mandrel is lowerable down into the mount against the force of a spring.

7. The loudspeaker stand according to claim 1, wherein the tensioning elements have a decoupling coating on their outward-facing surfaces.

8. The loudspeaker stand according to claim 7, wherein the decoupling coating is a flock coating.

9. The loudspeaker stand according to claim 1, wherein at least one tensioning element has a strip of an elastomeric material mounted on an outside surface thereof.

10. The loudspeaker stand according to claim 9, wherein the strip is inserted into a slot in the tensioning element.

11. The loudspeaker stand according to claim 10, wherein at least certain sections of the slot have a bottom which is parallel to the opposing wedge surfaces;

wherein the bottom of the slot has a shoulder near at least one opposing wedge surface; and where the inside surface of the strip which is inserted into the slot, has at least one hook which cooperates with the shoulder.

12. The loudspeaker stand according to claim 9, wherein the strip is arranged inside the elastic ring.

13. The loudspeaker stand according to claim 1, wherein the mount is connected to a pedestal base or tripod.

14. The loudspeaker stand according to claim 1, wherein the mount is connected to a wall bracket.

15. A mount for a loudspeaker stand, the mount comprising a tensioning element, which can be actuated by the intrinsic weight of a loudspeaker, and a fastening device for fastening the mount to a support, wherein the tensioning element can be shifted in a direction perpendicular to that in which the loudspeaker is set down, and further comprising an expanding mandrel with at least one wedge surface, which cooperates with an opposing wedge surface of a tensioning element.

* * * * *